US008059847B2

(12) United States Patent
Nordahn

(10) Patent No.: US 8,059,847 B2
(45) Date of Patent: Nov. 15, 2011

(54) HEARING AID METHOD FOR IN-SITU OCCLUSION EFFECT AND DIRECTLY TRANSMITTED SOUND MEASUREMENT

(75) Inventor: Morten Agerbak Nordahn, Bronshoj (DK)

(73) Assignee: Widex A/S, Lynge (DK)

( * ) Notice: Subject to any disclaimer, the term of this patent is extended or adjusted under 35 U.S.C. 154(b) by 536 days.

(21) Appl. No.: 12/362,112

(22) Filed: Jan. 29, 2009

(65) Prior Publication Data

US 2009/0129619 A1 May 21, 2009

Related U.S. Application Data

(63) Continuation-in-part of application No. PCT/EP2006/065125, filed on Aug. 7, 2006.

(51) Int. Cl.
*H04R 25/00* (2006.01)

(52) U.S. Cl. ..... 381/328; 381/60; 381/312

(58) Field of Classification Search ..... 381/23.1, 381/60, 312, 316–318, 322, 328
See application file for complete search history.

(56) References Cited

U.S. PATENT DOCUMENTS

| | | | |
|---|---|---|---|
| 6,766,031 | B1 | 7/2004 | Westermann |
| 7,031,484 | B2 | 4/2006 | Ludvigsen |

FOREIGN PATENT DOCUMENTS

| | | | |
|---|---|---|---|
| EP | 1594344 | A2 | 11/2005 |
| WO | 8901315 | A1 | 2/1989 |
| WO | 9422276 | A1 | 9/1994 |
| WO | 9723117 | A1 | 6/1997 |
| WO | 0044198 | A1 | 7/2000 |
| WO | 2007045271 | A1 | 4/2007 |

*Primary Examiner* — Suhan Ni
(74) *Attorney, Agent, or Firm* — Sughrue Mion, PLLC

(57) ABSTRACT

A hearing aid (100) comprises at least one first microphone (10) generating a first input signal from sounds external to a user of the hearing aid, signal processing means, a receiver (30) and, a second microphone (40) generating a second input signal from sounds in the occluded ear of the user. In a measurement mode the signal processing means produces an occlusion effect value or directly transmitted sound value from the difference between the sound levels of the second and the first input signals generated both at the same time while the receiver is silent. The invention further provides a system and a method for determining an occlusion effect and a directly transmitted sound value.

20 Claims, 11 Drawing Sheets

HEARING AID METHOD FOR IN-SITU OCCLUSION EFFECT AND DIRECTLY TRANSMITTED SOUND MEASUREMENT

RELATED APPLICATIONS

The present application is a continuation-in-part of application no. PCT/EP2006/065125 filed on Aug. 7, 2006 and published as WO-A1-2008017326, the contents of which are incorporated herein by reference.

BACKGROUND OF THE INVENTION

1. Field of the Invention

The present invention relates to the field of hearing aids. The invention, more specifically relates to hearing aids and methods utilizing in-situ occlusion effect or in-situ directly transmitted sound measurement. In addition, the invention relates to a method for vent size determination, a method for fitting a hearing aid based on measured in-situ occlusion effect, and a hearing aid with a customized ear plug.

2. Description of the Related Art

The occlusion effect is a well-known problem for hearing aid users. When someone speaks, sound is likely to propagate through bone conduction to the inside of the ear canal. The sound pressure level at the ear drum due to the person speaking is likely to increase on occluding the ear canal relative to the un-occluded ear canal, since the sound cannot escape the open ear anymore.

The occlusion effect is therefore also described as the low frequency boost of own voice that occurs when the ear is occluded. A user may thus perceive his or her own voice as hollow or booming, which in particular is annoying if the hearing loss is small in the low frequencies. Typically, the occlusion effect is alleviated by drilling a ventilation canal in the ear plug or shell. The larger the ventilation, the less occlusion effect remains. In today's hearing aid fitting situations, the decision on the vent size lies entirely by the dispenser, and is based on good judgment and rules of thumb. The amount of occlusion effect, which depends on the individual ear and the vent size, is only qualitatively assessed in fitting today. Once the ear plug for the user has been created, the dispenser, receiving the complaint of the user, can only advise the user to get used to the occlusion effect or offer drilling a larger hole through the plug. However, in particular for CIC and ITE hearing aids, drilling a larger vent is not possible, and would therefore demand the production of an entirely new hearing aid. It is therefore important to determine the right vent size in the first guess, demanding much experience in the field.

Usually the occlusion effect is remedied by venting without knowing an exact value for an appropriate vent size to just attenuate the low frequency part of any sound source within the ear.

U.S. Pat. No. 6,766,031 discloses an in-the-ear hearing aid wherein occlusion effect is defeated by providing a vent.

U.S. Pat. No. 7,031,484 discloses a hearing aid wherein the occlusion effect is countered by tuning the compressor to suppress the gain in low frequencies.

Regarding vent size determination, it is the standard practice when ordering a custom plug to decide on the vent size based on rules of thumb developed through experience. The plug will then be manufactured by, for example, a rapid prototyping method including a vent with a diameter as ordered. By the current practice it is therefore not possible to predict the occlusion effect very well.

Another important acoustic property of an ear plug is the propagation of sound from the outside and directly, i.e. not amplified by the hearing aid, into the inner part of the ear canal, which is called directly transmitted sound. Directly transmitted sound may interfere with signals output by the hearing aid causing a decrease of the speech intelligibility and overall sound quality for the user.

Thus, there is a need for improved hearing aids and methods for determining the occlusion effect and other acoustic effects as well as for fitting a hearing aid.

SUMMARY OF THE INVENTION

It is therefore a feature of the present invention to provide hearing aids and methods of in-situ occlusion effect measurement taking in particular the mentioned requirements and drawbacks of the prior art into account.

According to a first aspect, it is in particular a feature of the present invention to provide a hearing aid and a respective method which allows to determine the occlusion effect or the directly transmitted sound.

According to a first aspect of the invention, there is provided a hearing aid for measurement of in-situ occlusion effect or directly transmitted sound, said hearing aid comprising a first microphone adapted to generate a first input signal from sounds external to a user of the hearing aid; a signal processing means; a receiver; and a second microphone adapted to generate a second input signal from sounds in the occluded ear of the user; said signal processing means being adapted to generate a hearing loss compensated electric output signal from said first input signal, and said receiver being adapted to produce an acoustic output signal from said electric output signal; and said hearing aid being adapted to selectively enter a measurement mode, in which mode said receiver is silent and said signal processing means is adapted to produce at least one occlusion effect value or at least one directly transmitted sound value from the difference between simultaneously generated sound levels of the second and the first input signals.

According to a second aspect of the invention, there is provided a hearing aid system for measurement of occlusion effect or directly transmitted sound, the system comprising a pair of a first hearing aid for one ear of a user and a second hearing aid for the other ear of the user, wherein said first hearing aid comprises a first microphone adapted to generate a first input signal from sounds external to a user of the first hearing aid; a first signal processing means; and a first receiver; wherein said second hearing aid comprises a second microphone; a second signal processing means; and a second receiver; said first signal processing means being adapted to generate a hearing loss compensated electric output signal from said first input signal, and said first receiver is adapted to produce a first acoustic output signal from said electric output signal; and wherein said system is adapted to selectively enter a measurement mode wherein said second microphone is adapted to generate a second input signal from sounds in the occluded ear of the user, said second receiver is silent and one of said first or second signal processing means is adapted to produce at least one occlusion effect value or at least one directly transmitted sound from the difference between simultaneously generated sound levels of the second and the first input signals.

Such an embodiment has the advantage that in case of a person fitted binaurally, one hearing aid could be used to measure the sound in the occluded ear by means of, for example, a probe tube, while the opposite hearing aid could be relied on for measuring the ambient sound level.

According to an aspect of the present invention, the same or a similar hearing aid is relied on for measuring the sound pressure level in the occluded ear as well as in the un-occluded ear.

According to another aspect of the invention, there is provided a method for measurement of in-situ occlusion effect or direct transmission sound by means of a hearing aid having a first microphone for generating a first input signal from sounds external to a user of the hearing aid and a receiver, said method comprising the steps of generating a hearing loss compensated output signal from said first input signal output by the receiver in a normal hearing aid mode; switching said hearing aid from said normal hearing aid mode into a measurement mode, causing said receiver to be silent, and carrying out the following steps: simultaneously generating said first input signal and a second input signal, wherein said second input signal is generated by a second microphone from sounds in the occluded ear of the user; and calculating at least one occlusion effect or directly transmitted sound value from the difference between the sound levels of said second and first band-split input signals.

The hearing aids and methods according to the invention, provide determination of the amount of occlusion effect or directly transmitted sound present for an individual user, by performing a measurement without any other instruments than the hearing aids worn by the user anyway. This further allows quantifying the occlusion effect or the directly transmitted sound that the user actually experiences.

The directly transmitted sound can be measured by turning off amplification in the hearing aid, applying an external acoustic stimulus signal and measuring the sound outside and inside of the hearing aid. If the person is in conversation, the hearing aid will be able to single out signals that are louder outside than inside the ear canal, therefore necessarily due to external acoustic stimuli.

According to an embodiment, the hearing aids and methods are not only directed to measure the occlusion effect, but to measure both the occlusion effect as well as the directly transmitted sound through a vent in the plug or a leakage between the plug and the ear canal as well. Occlusion effect may occur only when the user himself speaks or utters. Directly transmitted sound may occur only from sound sources external to the user.

It is therefore another feature of the present invention to provide hearing aids and methods which are capable of distinguishing between sounds in front of the ear drum resulting from occlusion effect from sounds in front of the ear drum resulting from directly transmitted sound.

According to an aspect of the present invention, there is provided a hearing aid and a method to determine whether in at least one frequency band the sound level at the front of the ear drum is larger than that outside the ear and if this is the case to classify the input signals as valid for occlusion effect calculation. In the other case, if in at least one frequency band the sound level at the front of the ear drum is smaller than that outside the ear, the input signals are classified as valid for calculating a value of the directly transmitted sound from the first and second input signals. If however the sound level at the ear drum and/or the sound level externally to the ear is below a certain limit, the input signals are disregarded and, e.g. added to a noise buffer.

For occlusion effect measurement, the stimulus signal may be the sound of the hearing aid user reading aloud or speaking. If the hearing aid user is in conversation with someone else, it is still possible to measure the occlusion effect, as the hearing aid will be able to single out for measurement signals that are louder inside than outside the ear canal, therefore necessarily due to the hearing aid wearer speaking.

It is another feature of the present invention to provide methods, which allow fitting of a prospective hearing aid taking into account the occlusion effect.

According to an aspect of the present invention, there is provided a method for fitting a hearing aid to a user, said hearing aid having a first microphone for generating a first input signal from sounds external to a user of the hearing aid and a receiver, said method comprising the steps of generating a hearing loss compensated output signal from said first input signal output by the receiver in a normal hearing aid mode; switching said hearing aid from said normal hearing aid mode into a measurement mode, causing said receiver to be silent, and carrying out the following steps: simultaneously generating said first input signal and a second input signal, wherein said second input signal is generated by a second microphone from sounds in the occluded ear of the user; calculating at least one occlusion effect or directly transmitted sound value from the difference between the sound levels of said second and first band-split input signals; and fitting said hearing aid based on at least one of said occlusion effect value and said directly transmitted sound value.

It is another feature of the present invention to provide methods, which allow automatic vent size counseling regarding a hearing aid based on in-situ occlusion effect measurement.

According to an aspect of the present invention, there is provided a method for vent size determination for a hearing aid by means of in-situ occlusion effect measurement, said hearing aid having a first microphone for generating a first input signal from sounds external to a user of the hearing aid and a receiver, said method comprising the steps of providing an ear of a user with a prospective hearing aid and, said prospective hearing aid occluding said ear of the user; generating a hearing loss compensated output signal from said first input signal output by the receiver in a normal hearing aid mode; switching said hearing aid from said normal hearing aid mode into a measurement mode, causing said receiver to be silent, and carrying out the following steps simultaneously generating said first input signal and a second input signal, wherein said second input signal is generated by a second microphone from sounds in the occluded ear of the user;—calculating at least one occlusion effect or directly transmitted sound value from the difference between the sound levels of said second and first input signals; and determining the vent size for said hearing aid based on at least one of the calculated occlusion effect and the directly transmitted sound value.

Thus, it is suggested to fit a prospective hearing aid user provisionally with, for example, a BTE hearing aid with a soft plug and not a customized plug and then measure the occlusion effect. Based on information from this measurement, it is possible at the stage of ordering a custom plug to make an informed decision about the size of the vent.

According to another aspect of the invention, measurements of the occlusion effect or of the directly transmitted sound are used for deriving a more accurate mathematical model of the acoustic properties of the plug and the vent. The model can be used to evaluate possible mechanical modifications so as to provide information for a targeted modification of the vent, if necessary.

According to another aspect of the present invention, there is provided a hearing aid comprising a customized vented ear plug, wherein the size of the vent of said ear plug is determined by using a method as described herein.

The invention, according to further aspects, provides a system for measurement of in-situ occlusion effect or directly transmitted sound by use of a hearing aid, the hearing aid having a first microphone adapted to generate a first input signal from sounds external to a user of the hearing aid; a signal processing means; a receiver; and a second microphone adapted to generate a second input signal from sounds in the occluded ear of the user; said signal processing means being adapted in a normal hearing aid mode to generate a hearing loss compensated electric output signal from said first input signal, and said receiver being adapted to produce an acoustic output signal from said electric output signal; said system comprising a data processing system; and a computer program, which when executed on said data processing system enables the system to switch said hearing aid from said normal hearing aid mode into a measurement mode, causing said receiver to be silent, and carrying out the following steps simultaneously generating said first input signal and a second input signal, wherein said second input signal is generated by a second microphone from sounds in the occluded ear of the user; and calculating at least one occlusion effect or directly transmitted sound value from the difference between the sound levels of said second and first band-split input signals.

Further specific variations of the invention are defined by the further dependent claims.

Other aspects and advantages of the present invention will become more apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, wherein like reference numerals designate like structural elements, and in which:

FIGS. 6*a*-6*c* illustrate plots visualizing the occlusion effect according to embodiments of the present invention;

DESCRIPTION OF EMBODIMENTS OF THE INVENTION

When describing the invention according to embodiments thereof, terms will be used which are described as follows.

The occlusion effect (OE) is defined as the difference between the sound levels just in front of the ear drum in the occluded versus the un-occluded ear while the user speaks or vocalizes sound and when the hearing aid is not active.

The sound uttered by a user is generated in the throat (glottis) as harmonics of a fundamental frequency, and is shaped by the area function of the vocal tract. The sound generated spreads as air conducted sound as well as bone conducted sound, the latter in form of vibrations in the skull. In the ear canal, mainly the cartilaginous part of the ear canal radiates sound into the ear canal. This sound mainly propagates out of the open ear, but in case the ear is occluded, mainly the low frequency part of this sound propagates to the eardrum instead. This increases the low frequency sound pressure at the eardrum in the occluded ear relative to the un-occluded ear. The occlusion effect therefore refers to voiced sounds generated by the user, and depends on both the earplug dimensions and the physical properties of the ear canal and eardrum. Particularly, the occlusion effect depends on the physical properties of the cartilaginous part of the ear canal as a sound source. The hearing aid must remain inactive during occlusion measurements, since the sound source is the users own voice.

The directly transmitted sound (also called direct transmission gain (DTG)) is defined as the difference between the sound levels just in front of the ear drum in the vented ear versus outside the ear of the user due to sound generated by another person, e.g. the dispenser, speaking or vocalizing sound, or by an external sound source, e.g. a loudspeaker, while the user is silent and while the hearing aid is not active.

A measurement at the outside of a hearing aid, i.e. by the normal microphone of the hearing aid, can be assumed to represent accurately the sound level at the ear drum, at least for sounds at frequencies up until 1 kHz. This is satisfactory, as there are no significant occlusion problems at frequencies above that.

According to a first aspect of the present invention, an embodiment is based on diagnosing the amount of occlusion effect present for an individual user, by performing a measurement of the sound pressure levels at the inside, i.e. at the receiver side, and the outside of the hearing aid without any other instruments than the hearing aid, and analyzing and visualizing this measurement by use of a fitting software. This quantifies the occlusion effect that the user experiences.

Figure 1:
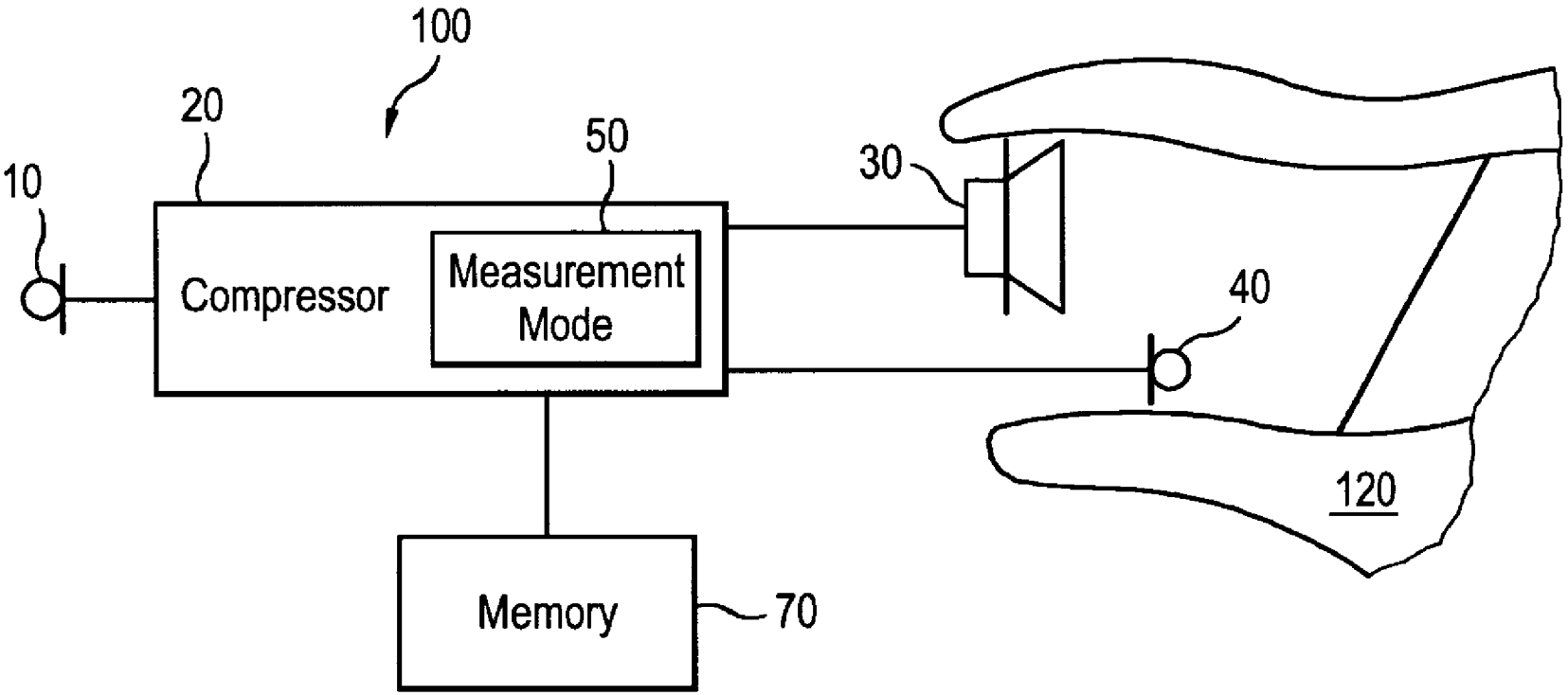
FIG. 1 illustrates a block diagram of hearing aid according to a first embodiment of the present invention.

Reference is now made to FIG. 1, which shows a block diagram of a hearing aid 100 according to the first embodiment of the present invention.

Figure 12:
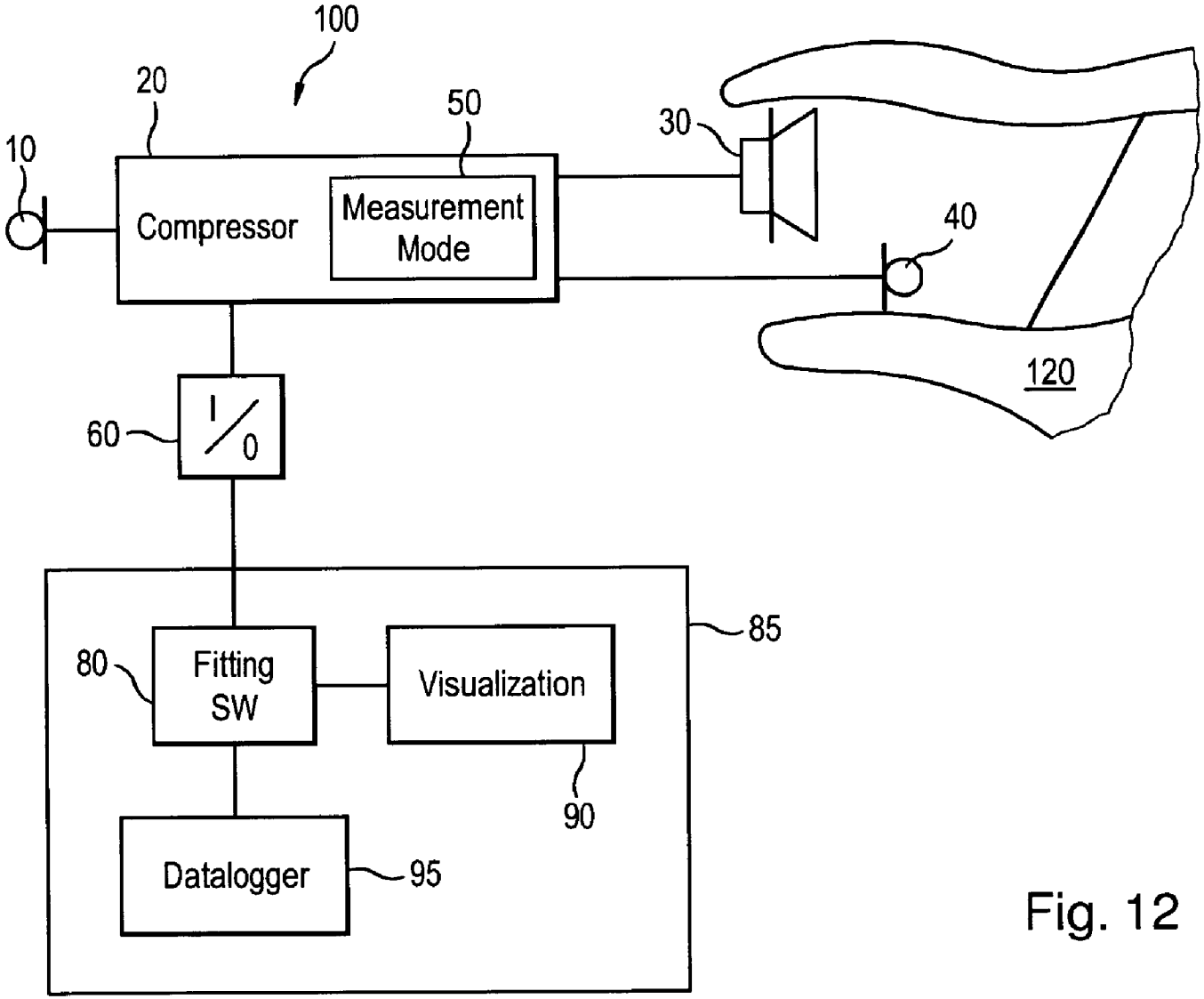
FIG. 12 illustrates a block diagram of a system according to an embodiment of the present invention.

The hearing aid comprises a first microphone 10 transforming an acoustic input signal into an electrical first input signal, and an A/D-converter (not shown) for sampling and digitizing the analogue electrical signal. The processed first input signal is then feed into signal processing means like a compressor 20 generating an electrical output signal by applying a compressor gain in order to produce an output signal that is hearing loss compensated to the user requirements. The signal path further comprises a receiver 30 transforming the electrical output signal into an acoustic output signal. The hearing aid further comprises a second microphone 40 generating a second input signal from sounds in the occluded ear 120 of the user. The hearing aid is capable of switching into a measurement mode 50. This is, e.g., controlled by a fitting software 80 (Re. FIG. 12) functionally connected via an interface or I/O circuit 60 to the hearing aid 100 during fitting of the hearing aid. In the measurement mode, the signal processing means produces at least one occlusion effect value from the difference between the sound levels of the second and the first input signals generated both at the same time and while the receiver is silent. According to an embodiment, the occlusion effect values and also other signal values like the sound pressure levels (SPL) of the input signals are stored in a memory 70 of the hearing aid.

According to an embodiment, the hearing aid further comprises at least one band-split filter (not shown) for converting the input signals into band-split input signals of a plurality of frequency bands. The hearing aid then produces the occlusion effect value or directly transmitted sound value in at least one of the frequency bands. According to another embodiment, the hearing aid processes the band-split input signals in each of said frequency bands independently to produce a band-split occlusion effect value. For example, the signals are divided into 15 different frequency bands and the occlusion effect or the directly transmitted sound is produced for at least one band below 1 kHz.

Figure 2:
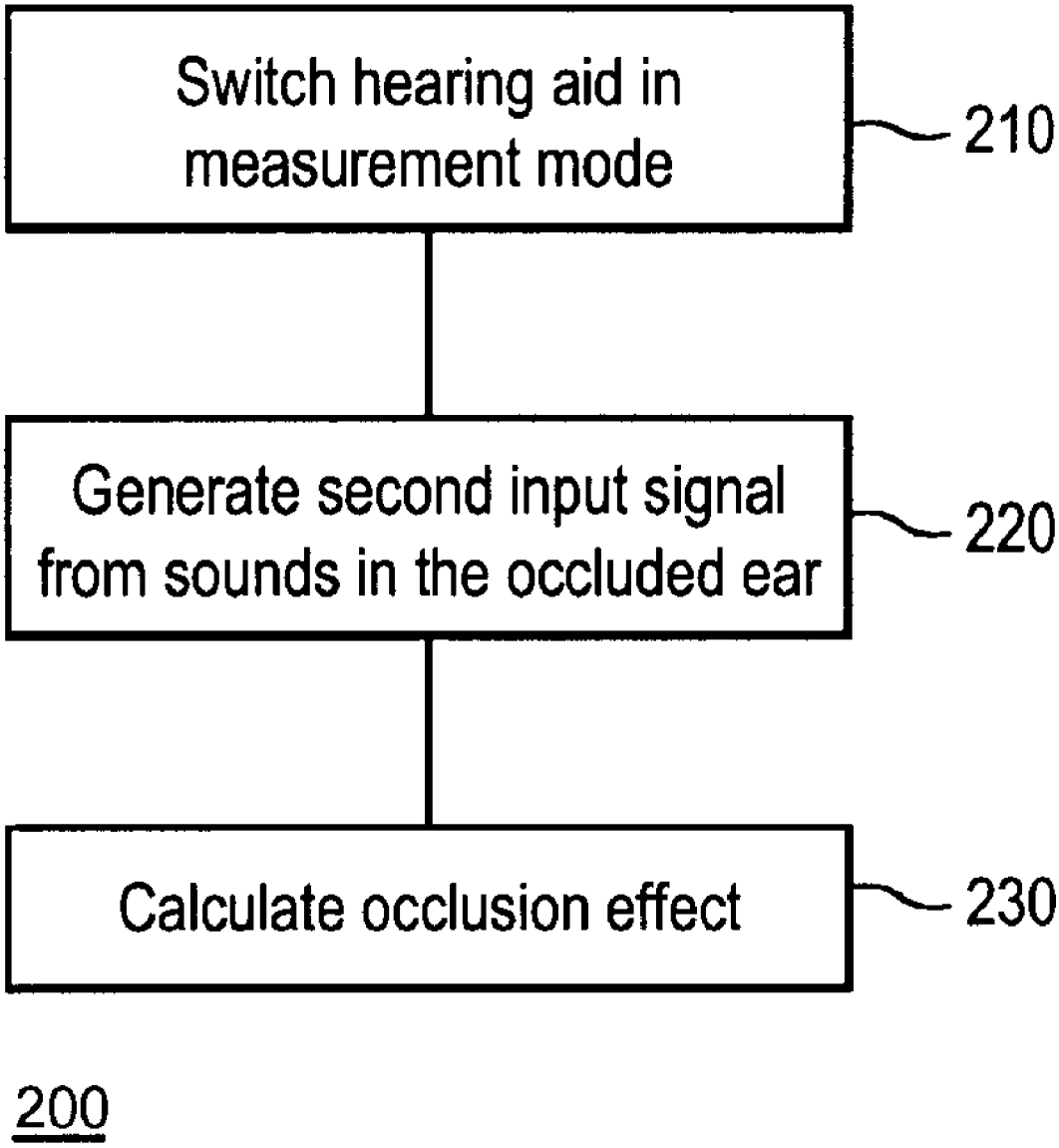
FIG. 2 illustrates a flow chart of a method according to an embodiment of the present invention.

According to an embodiment, the hearing aid is mounted in the ear during fitting, and all mandatory tests such as determination of hearing threshold, fine tuning etc takes place. The occlusion effect measurement may take place immediately after the mandatory tests and will now be described with reference to FIG. 2 showing a flow chart 200. The hearing aid is switched in a measurement mode (step 210) in which the hearing aid is in a "listening situation", where the first microphone records the sound outside the ear as first input signals and the second microphone records the sounds inside the ear canal at the ear drum (step 220) as second input signals. In the measurement mode, the hearing aid is inactive which means that no sound is produced by the receiver. This can be achieved by switching off the receiver, driving the compressor not to produce any output signal or any other appropriate measure readily apparent to a skilled person to ensure that the receiver is silent. The occlusion effect measurement is performed while the user reads aloud a passage from a text, or talks to the audiologist. It is necessary that the users own voice is used. The time varying sound level generated by the users own voice is recorded simultaneously inside and outside the ear by first and second microphones 10, 40, and the ratio between SPLs of these signals is calculated as at least one occlusion effect value in step 230. According to an embodiment, the occlusion effect is calculated over time, giving a time dependent occlusion effect during speech of the user.

According to an embodiment, the hearing aid records the sound signals or the occlusion effect values in storage means by using either an internal memory 70 or a data logging system (datalogger 95 in FIG. 12) external to the hearing aid and part of the system as described with reference to FIG. 12. The stored signal and other values are then transmitted to the fitting software 80 to be analyzed. Alternatively, the signals are fed directly sample by sample to the software.

According to another embodiment, the occlusion effect is calculated as the calibrated ratio between the second input signal from inside the ear canal and the first input signal from the first microphone, cleared for noise, and shown on a visualization means 90, for example a graphical user interface on a computer executing the fitting software.

The occlusion effect depends on acoustic utterances of the user producing the first and second input signals. For example, voiced phonemes such as /aaa/ have almost no or even negative occlusion effect, whereas /eee/ can produce up to some 20 dB or even more at low frequencies. Also the pitch has an effect on the occlusion effect. The advantage of this method is therefore, that the occlusion effect during regular speech is recorded, thus providing a fuller picture of the time- and signal dependent occlusion effect as it is perceived by the user.

The measured occlusion effect is analyzed and visualized in the fitting software 80 such as Compass (a software by WIDEX A/S for programming the hearing aid). The result is used for quantifying the occlusion effect, and assessing how much the ventilation canal (vent) could be changed in order to obtain an occlusion effect, which lies below a certain acceptable limit.

Measuring the occlusion effect ideally demands a simultaneous measurement of the sound pressure at the ear drum in the occluded ear and in the un-occluded ear. The difference in dB between these two spectra gives the frequency- and time-dependent occlusion effect. The sound pressure at the non-occluded eardrum during own speech is dominated by air borne sound. This means that the low frequency part of the sound at the hearing aid microphone is approximately the same as the sound at the ear drum for frequencies below approximately 1 kHz. The sound registered by a hearing aid microphone which is usually used for measuring the sound from the surroundings and which is amplified by the hearing aid can therefore be used as a measurement of the sound pressure in the un-occluded ear.

In the following, embodiments of the hearing aid for measuring the first (un-occluded) and the second (occluded) input signal will be described with reference to FIGS. 3-5. According to embodiments, the sound pressure at the eardrum in the occluded ear is assessed either by use of the receiver, by use of a built-in microphone at a receiver side of the hearing aid or by use of a probe tube connected to the second hearing aid microphone of a directional hearing aid using two microphones. Thus, according to embodiments, the second microphone is not an additional microphone but a sensing means or a microphone which is present anyway, like one microphone of a directional microphone system or of a plurality of microphones in a hearing aid, e.g., normally providing higher order characteristic input signals.

Figure 3:
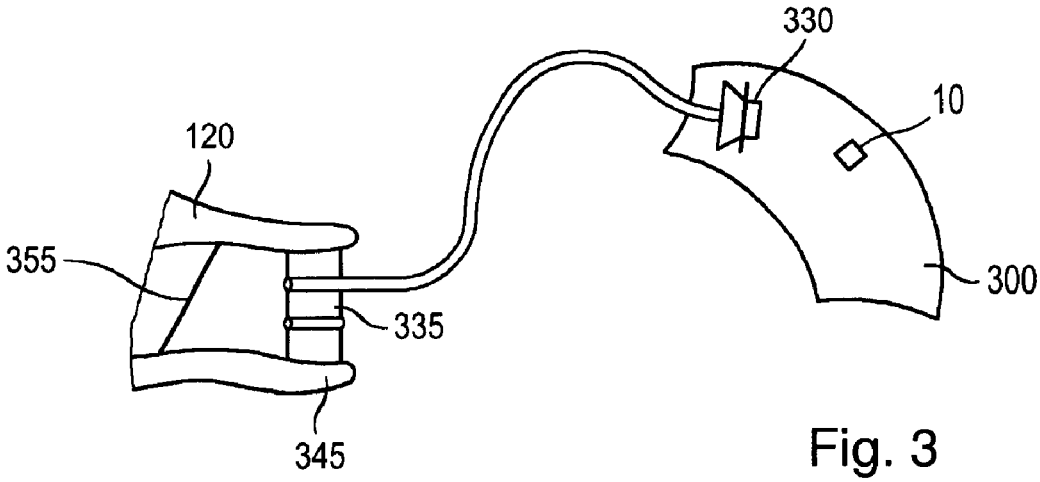
FIG. 3 illustrates a hearing aid according to an embodiment of the present invention.

According to the embodiment in FIG. 3, a receiver 330 is used as the second microphone in hearing aid 300. Thus, the second microphone 40 at the receiver side in the embodiment in FIG. 1 is not necessary here. The advantage of using the receiver as internal microphone lies in the ease of application and elegance of the measurement, since a probe tube measurement or external equipment is unnecessary. Measurements have shown that the receiver is reciprocal, meaning that it may function as a microphone when connected as one. The sensitivity may be not as good as a hearing aid microphone, but the sound pressure in the occluded ear is very large, so it is still applicable. By rerouting the receiver connections in the hearing aid, the receiver is switched between being a sound generator in normal hearing aid mode and a sound recorder in the measurement mode. In this rerouting, which takes place during fitting only, the receiver replaces the second microphone sensing the SPL in the occluded ear at the ear drum 355.

Figure 4:
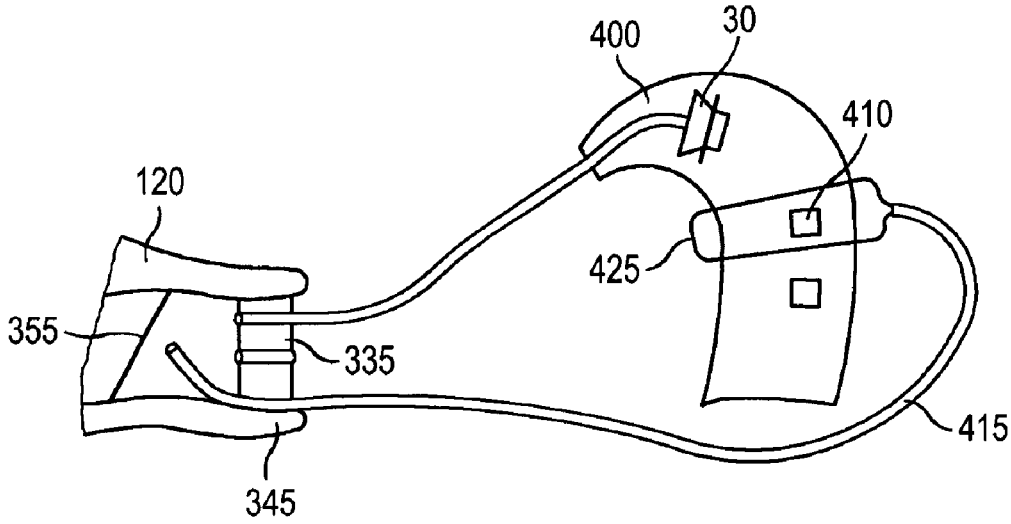
FIG. 4 illustrates a hearing aid according to another embodiment of the present invention.

According to the embodiment in FIG. 4, a behind-the-ear (BTE) hearing aid 400 uses a probe tube 415. The probe tube is attached to one of the microphones 410 of the hearing aid by use of an attachment device 425, which straps onto the BTE hearing aid. By inserting the probe tube into the ear, for example feeding it between the ear plug 335 and the ear canal 345, sound may propagate from the eardrum 355 through the probe tube to the microphone of the hearing aid. The probe tube has preferably a diameter between 0.2 and 1 mm and in particular preferably of about 0.5 mm.

Figure 5:
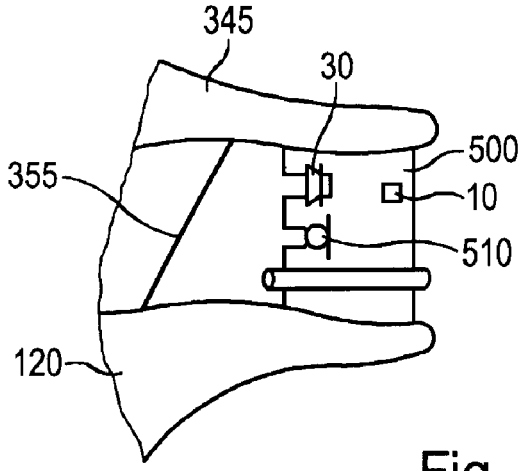
FIG. 5 illustrates a hearing aid according to still another embodiment of the present invention.

According to the embodiment in FIG. 5, a completely-in-the-canal (CIC) or in-the-ear (ITE) hearing aid 500 uses as second microphone a built-in microphone 510 at the receiver side of the hearing aid.

In the following embodiments measuring the sound pressure level of the first input signal of the un-occluded ear canal will be described.

By using a directional hearing aid with at least two microphones, the one microphone is used as the first microphone to measure the external sound pressure level in the case the other microphone is occupied, i.e., by the probe tube for internal sound pressure measurement.

By using a one-microphone hearing aid, the microphone in the hearing aid is used as first microphone for measuring the external sound pressure, while, e.g., the receiver measures the internal sound pressure in the measurement mode.

According to an embodiment, the method comprises a simultaneous bilateral measurement using a pair of hearing aids, with one ear occluded and the other open. In the measurement mode, the sound pressure is simultaneously monitored by use of a first hearing aid with a first microphone recording sounds external to a user and a second hearing aid in the other ear of the user with a second microphone, e.g. a probe tube microphone, recording the sounds at the ear drum while the user e.g. reads aloud from a text passage. At least the receiver in the second hearing aid is silent and the occlusion effect is calculated from the difference between the sound levels recorded by the second and the first microphones simultaneously. For the calculation, the recorded sound pressure level values are collected at one of the two hearing aids or directly transmitted to the fitting software for further processing. The objective occlusion effect is calculated as the ratio between the time-frequency spectra of the signal in the occluded ear relative to that outside the ear.

To get in particular representative results in a binaural fitting situation, the first and the second microphones each in one ear of the user have attached probe tubes inserted at equal depth in each ear. One ear is occluded and the other one is open. Thus, both sound pressure levels are measured inside the ear canal at the ear drum, according to this embodiment.

According to another embodiment, the microphone of a first hearing aid is placed on one side of the head for measuring the external sound pressure, whilst measuring the internal sound pressure on the other side of the head is carried out by a second hearing aid with either a probe tube microphone, a built-in inner microphone or a receiver microphone.

According to still another embodiment, any measurement device for measuring the external sound pressure is used, whilst the internal sound pressure is measured with either a probe tube microphone, a built-in inner microphone or a receiver microphone of the hearing aid.

The signals recorded from the microphones are then processed as follows. According to one embodiment, the simultaneously measured external and internal raw signals are fed directly to the fitting software. According to another embodiment, the simultaneously measured external and internal signal strengths in each band are sampled and fed to the fitting software. This is obtained, for example, through so-called level-reports in the hearing aid, which are regularly used for many purposes in today's hearing aids. Then, the calibrated ratio between the internal and the external signal strengths gives the occlusion effect, which may be rooted by the fitting software for periods of silence, powerful noise etc.

Figure 10:
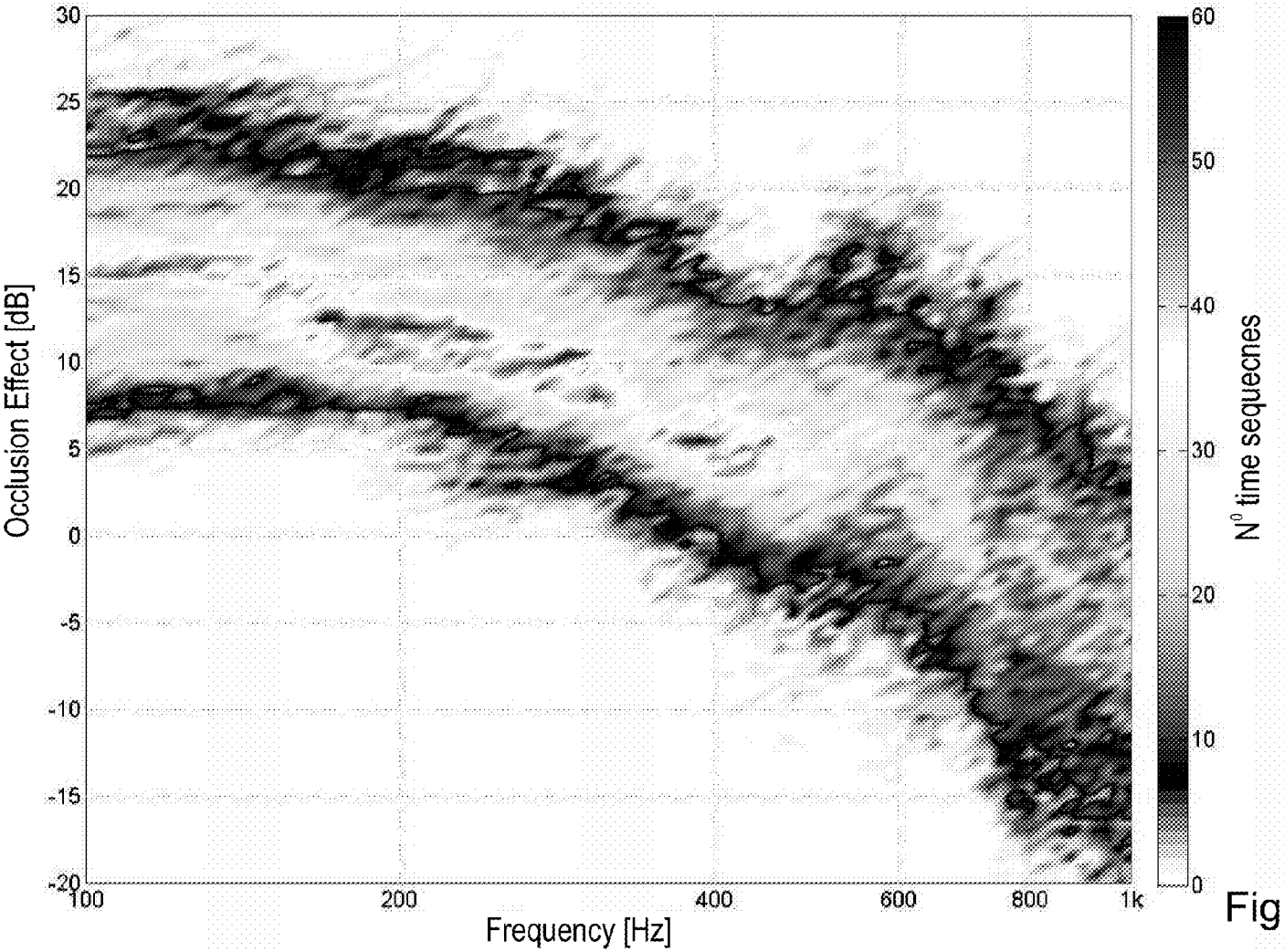

According to further embodiments, the measured sound pressure level values are analyzed and then the occlusion effect or the directly transmitted sound is calculated. In case the user reads a text passage, the occlusion effect is calculated as the ratio between the time-frequency spectrum of the simultaneously recorded signals of the second microphone (occluded) and the first microphone (non-occluded) respectively. This gives a time and frequency dependent occlusion effect. In order to rearrange data to give a better understanding and overview, the distribution of the occlusion effect at each frequency is calculated. This gives a contour-plot as depicted in FIG. 10 containing the number of time sequences, which gives an occlusion effect of a certain value at a certain frequency. If e.g. the user only vocalizes /iii/, the result would be a narrow distribution around e.g. 20 dB at low frequencies.

Figure 11:
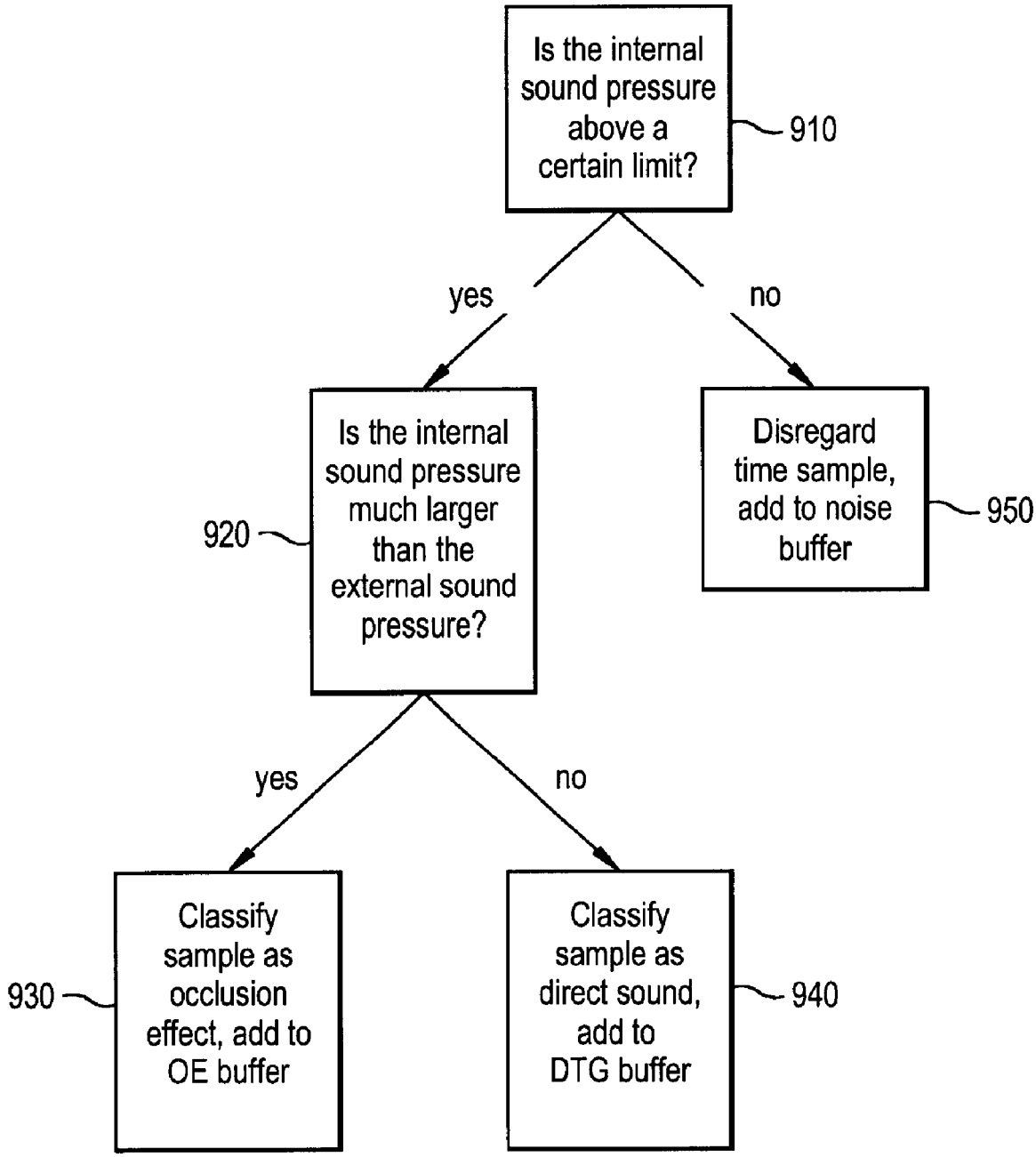
FIG. 11 illustrates a flow chart of a method according to an embodiment of the present invention.

It is not only the occlusion effect that can be measured but also directly transmitted sound through, e.g., a vented ear plug, as this will now be described with reference to FIG. 11 showing a flow chart of a method according another embodiment. This method functions exactly like the measurement of the OE, except that the user does not read from a text, but, e.g., engages in a dialogue with another person like the dispenser. The fitting software continuously samples the frequency dependent sound pressure levels from the internal and external microphones. The sound pressure at the external microphone has approximately the same amplitude independent of whether the speaker is the user or the dispenser. However, the internal microphone senses a very large sound pressure when the user speaks, relative to when the dispenser speaks, in particular in the low frequencies. Furthermore, the ear plug attenuates external sound, so when the dispenser speaks, the internal sound pressure is smaller than the external sound pressure, especially at higher frequencies. According to an embodiment, this gives a cue for dividing the time samples into two measurement groups, namely the in-situ OE when the user speaks and the in-situ DTG when the dispenser speaks as depicted in FIG. 11. In step 920 of FIG. 11, it is determined whether the internal SPL is larger in at least one frequency band compared to the external SPL. And if this is the case, the SPL samples are classified as valid for OE measurement (step 930). If the external SPL is larger, then the SPL samples are classified as valid for DTG measurement (step 940). The OE and DTG samples may then be added to respective buffers for storage of the OE and DTG values.

The occlusion effect samples may be contaminated by noise during the time segments, where the user is silent. During breaks in the speech, both of the recorded signals contain random noise, the ratio of which is random. This gives values of the occlusion effect, which have no physical interpretation. According to the embodiment described with reference to FIG. 10, this is compensated by disregarding time segments with no signal, or for each time segment to disregard the part of the spectrum where no signal is present. The result is a distribution at each frequency, the average value of which approximately corresponds to the long-term frequency spectrum of the speech.

Therefore, time samples containing no significant signal will be disregarded in the analysis in step 950 if it is determined in step 910 that they are under a predetermined sound pressure level below which the sound is regarded as noise. With that, it is achieved to avoid or at least to reduce the introduction of noise to the measurement.

In case the user reads a text passage, also the ratio of the long term spectrum gives the occlusion effect according to an embodiment. The spectra are extracted from the hearing aid sound processing, e.g. by the level reports containing information about the spectral energy contents of the signals.

If the user vocalizes a sound e.g. /iii/ or /uuu/ or any other, also the ratio of the long term spectra gives the occlusion effect.

Regarding signal analysis, the simultaneous bilateral measurement offers a unique opportunity to analyze the occlusion effect as a function of time. According to an embodiment, systematic measurements of the variables of the objective occlusion effect during running speech is carried out. The temporal aspect of the occlusion effect is implemented in the analysis by use of a histogram approach. This histogram analysis depicts the distribution of the occlusion effect at each frequency instead of the conventional single value. In this way, not only the average frequency dependent occlusion effect is observed from the data, but also the temporal spread is assessed. Furthermore, by discarding non-speech time segments, the result of the method is made independent of pauses in the speech, coughs, swallowing etc.

According to embodiments, the time and frequency dependent occlusion effect and the directly transmitted sound is visualized in at least one way by visualization means 90: As a single value determined as, e.g., an average occlusion effect over time and selected bands (at least one), as a band/frequency dependent curve showing the time-average occlusion effect in each band or in selected bands, as a time dependent curve showing the average occlusion effect over selected bands (at least one) as function of time, as a distribution of the time dependent occlusion effect as function of band/frequency, or as any of the above as accumulation during time. The last view then may be a single number showing the occlusion effect as an accumulated average of the occlusion effect from the beginning of the measurement. This value would stabilize with time.

According to an embodiment, the hearing aid 100 reports the level of sound in each frequency band at each microphone a number of times every second to the fitting software 80. This time- and frequency dependent sound pressure level may be analyzed and visualized by visualization means 90 in different ways as described above.

Figure 6A:
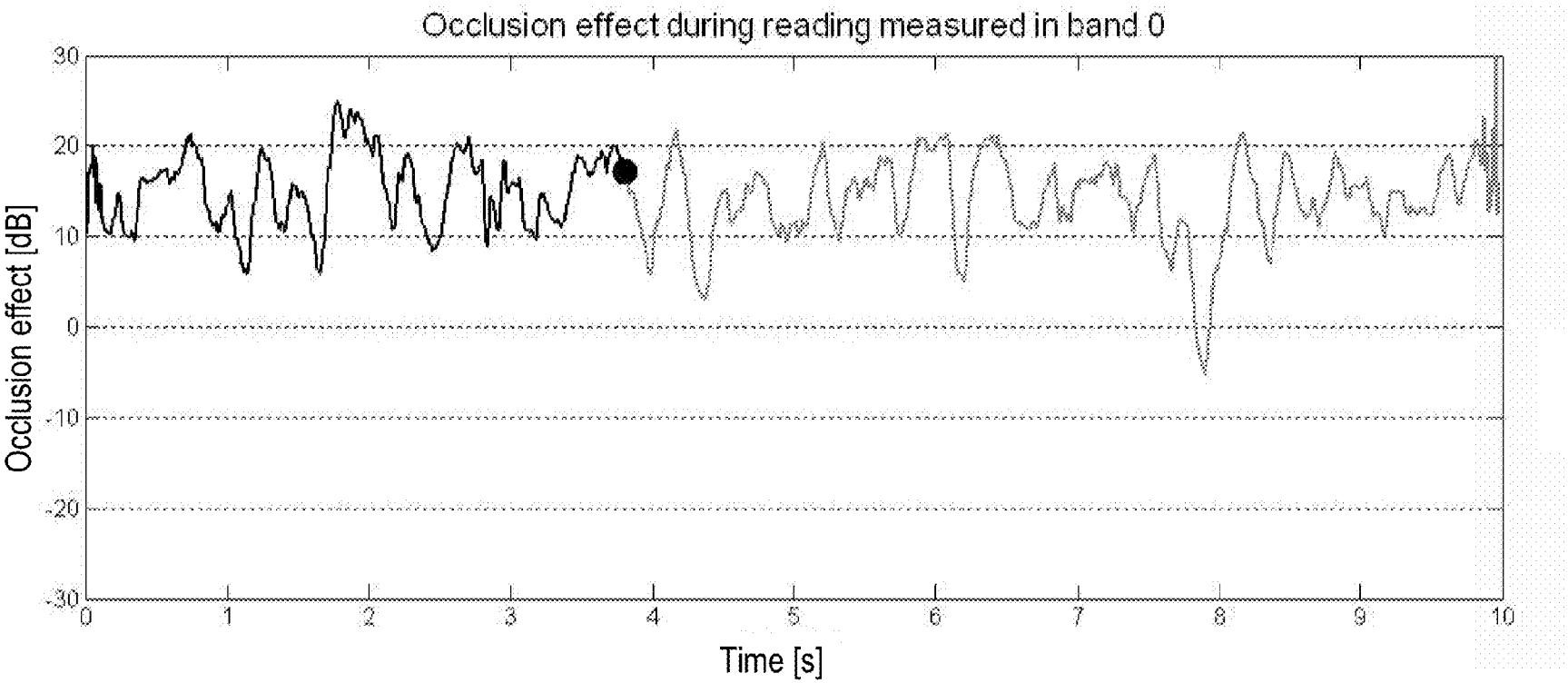
Figure 6B:
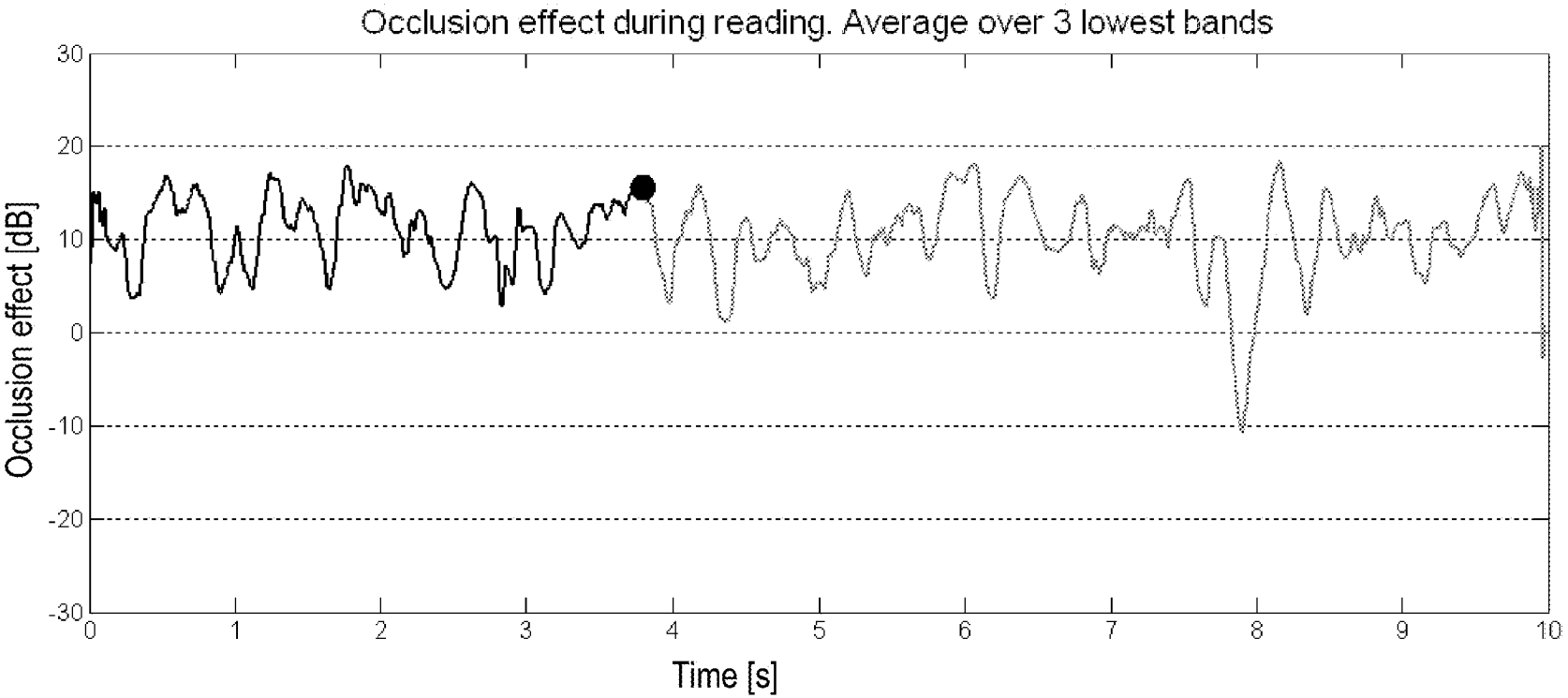

As depicted in FIG. 6*a*-6*c*, at least two different curve-views are possible. According to the view as depicted in FIGS. 6*a* and 6*b*, the OE is shown at certain bands as function of time. FIG. 6*a* shows the OE during reading by the user as measured in band 0. FIG. 6*b* shows the average of the OE over the three lowest bands during reading by the user. Another view is depicted in FIG. 6*c*, showing the OE at a certain time t=2.8 s as function of frequency during reading by the user. The two plots as depicted in FIGS. 6*a* and 6*b*, are drawn as time goes, following the development in OE at e.g. band 0 as function of time. The gray curve to the right hand side of the dot has not yet been measured, and can of course not be visualized, but is shown here to indicate how the OE could develop. The plot as depicted in FIG. 6*c* shows the band dependent OE. This plot changes with time without tracing the time development, like a frequency synthesizer on a stereo.

Another way of viewing the data is accumulating the development both in frequency and time in a plot showing the occlusion effect distribution over time at each frequency bin or band. FIG. 10 depicts a plot showing the distribution over time at each frequency bin in a range between 100 Hz and 1 kHz. The plot thus shows the temporal histogram of the occlusion effect. At each frequency bin and occlusion effect value, the color (or grayscale) indicates the number of time segments during the entire vocalization that have that particular occlusion effect value and frequency. This plot will develop and accumulate in time. For example, if the subject vocalizes an /aaa/-sound (e.g. "mark"), the OE would accumulate at between 0 and 5 dB, whereas the occlusion effect would build up between 15 and 20 dB when the subject vocalizes an /iii/ sound (e.g. "beetle").

According to another aspect of the present invention, the measured in-situ occlusion effect is used during fitting of the hearing aid for vent size determination which will now be described.

During a fitting session, real-ear measurement is performed in order to match the output signal of the hearing aid to the hearing loss of the user. Typically, the hearing aid is fitted utilizing an in-situ threshold measurement procedure, called Sensogram e.g. as explained in WO 9422276, and WO 0044198. During this procedure, the user wears the hearing aid and responds to acoustic signals that are generated from the fitting software or by the dispenser for a threshold response. The in-situ thresholds provide a base for deriving the initial gain settings for the hearing aid. This procedure is also designed to take into account the residual ear canal volume of the user and the individual acoustic properties of the hearing aid shell or ear mould. The direct method of threshold estimation is intended to minimize individual variability and real-ear errors in threshold measurements to yield more accurate real-ear thresholds. According to the present invention, the method now also takes the occlusion effect into account to determine an appropriate gain or an appropriate vent size for the hearing aid.

Figure 7:
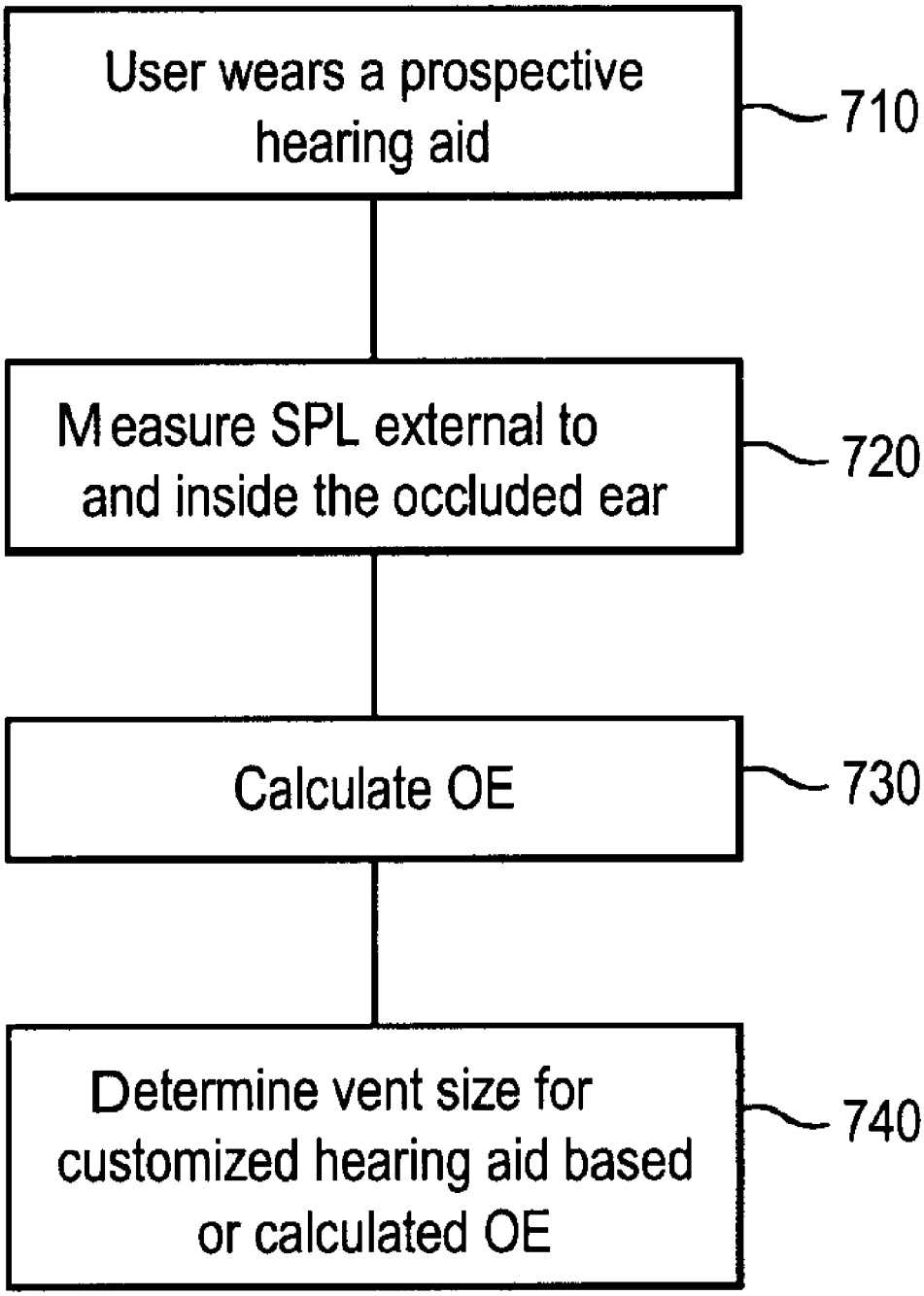
FIG. 7 illustrates a flow chart of a method according to an embodiment of the present invention.

According to an embodiment, the measurement of the occlusion effect is made during pre-fitting and/or during the actual fitting routine, when the individual plug has been fabricated. With reference to FIG. 7, a method for vent size determination according to an embodiment will be described. The user is provided with a prospective hearing aid for pre-fitting (step 710). When the measurement is performed during pre-fitting where the dispenser takes an impression of the ear canal, determines the type of hearing aid needed, determines the vent size, orders the individual plug etc., a soft silicone ear tip (also called soft plug) is used and inserted in the ear canal of the user in order to calculate the size of a vent of a customized plug depending on the in-situ occlusion effect measured by use of that soft plug. This soft plug is not individual and can be instantly mounted on a hearing aid so the occlusion effect may be measured. In step 720, the sound pressure levels inside the occluded ear and external to the ear are measured. Then, the occlusion effect is calculated as described herein (step 730). The occlusion effect will have approximately the same value for the un-vented individual plug as for the soft plug. Therefore, the preliminary occlusion effect measurement may be used to determine the optimum vent size of the individual plug. It is stated in the literature that the maximum tolerable occlusion effect is around 4-6 dB. If e.g. the user has a measured occlusion effect of 20 dB at 250 Hz by use of an un-vented ear plug, the occlusion effect needs to be reduced about 15 dB, which means that the vent needs to have a diameter of e.g. 2.5 mm according to, e.g., a pre-calculated table providing different vent size values for different OE reductions. Thus, an appropriate vent size for a customized hearing aid for the user based on the measured occlusion effect is determined (step 740).

According to another embodiment, the hearing loss may also be included in the vent diameter determination, since users with high low-frequency loss simply does not hear the occlusion effect to the same degree as a user with normal low-frequency hearing.

The information about the size of the vent is sent to the hearing aid manufacturer who may then produce a customized ear plug for the user taking the measured occlusion effect into account.

According to another aspect of the present invention, an automatic vent size counselling based on the measured occlusion effect and a transfer function of the hearing aid is provided and will now be described.

PCT application WO 2007/045271 (PCT/EP2005/055305) titled "Method and system for fitting a hearing aid", which is assigned to the same applicant and herewith incorporated by reference, provides a method for estimating otherwise unknown functions such as the vent effect and the direct transmission gain for an in-situ hearing aid. The derived estimate of the direct transmission gain represents the amplification of sound from the outside of the vent to the eardrum. The vent effect is defined as the frequency dependent change in sound pressure at the ear drum consequent to drilling a vent in the ear plug.

These functions are used for correcting the in-situ audiogram (Sensogram), the hearing aid gain as well as compensating for the direct transmission gain by the vent effect. According to an embodiment, in-situ occlusion effect and directly transmitted sound measurements are used for automatic vent size counselling taking at least one transfer function of the hearing aid into account.

According to an embodiment, the information obtained by the occlusion effect measurement is used as an input to a possible change in the dimensions of the vent. By measuring the occlusion effect during use of the particular plug for the particular user, it is possible for the dispenser to quantify the users problem which might be that the plug gives rise to an occlusion effect which is too annoying for the user. In the literature it is described that the occlusion becomes a subjective problem when the objective occlusion effect exceeds some 6-10 dB at 250 Hz. According to the method described with reference to FIG. 7, an estimate is obtained from the occlusion effect concerning how much the vent size should be increased in order to obtain an occlusion effect below or on that limit. However, by changing the vent size, one would expect the acoustics of the entire system to change. In the publication WO 2007/045271 (PCT/EP2005/055305), the measured feed back test (FBT) as transfer function of the hearing aid was used to estimate the in-situ vent effect (VE), and thereby the effective vent diameter of the ear plug on that particular user. With this effective vent diameter, an estimate of the total acoustic system has been derived from the measured FBT. Therefore, it is possible to estimate what would happen with e.g. the risk for feedback, the VE or the directly transmitted sound (DTG), if the vent was modified, as dictated by the measured OE.

For example, the user has a measured OE at 250 Hz of 14 dB. The physical vent size is 1.5 mmØ. The method as described in PCT/EP2005/055305 estimates the effective vent size to be 1.3 mm. The discrepancy may arise due to a longer vent or a larger residual volume, the effect of which is included in the effective vent size. If the OE should be lowered to below 6 dB, we would need an 8 dB decrease of sound pressure at 250 Hz. The method from PCT/EP2005/055305 may inform that this can be obtained by increasing the effective vent diameter to 2.5mmØ, that this increase would mean that the risk for feedback is still low, and that the DTG would increase frequencies above 300 Hz. Another example shows that a given increase in vent diameter would lead to a significant increase in the risk for feedback. In that case, the recommended increase in vent diameter would be a compromise between the occlusion relief and the increase in risk for feedback.

Figure 8:
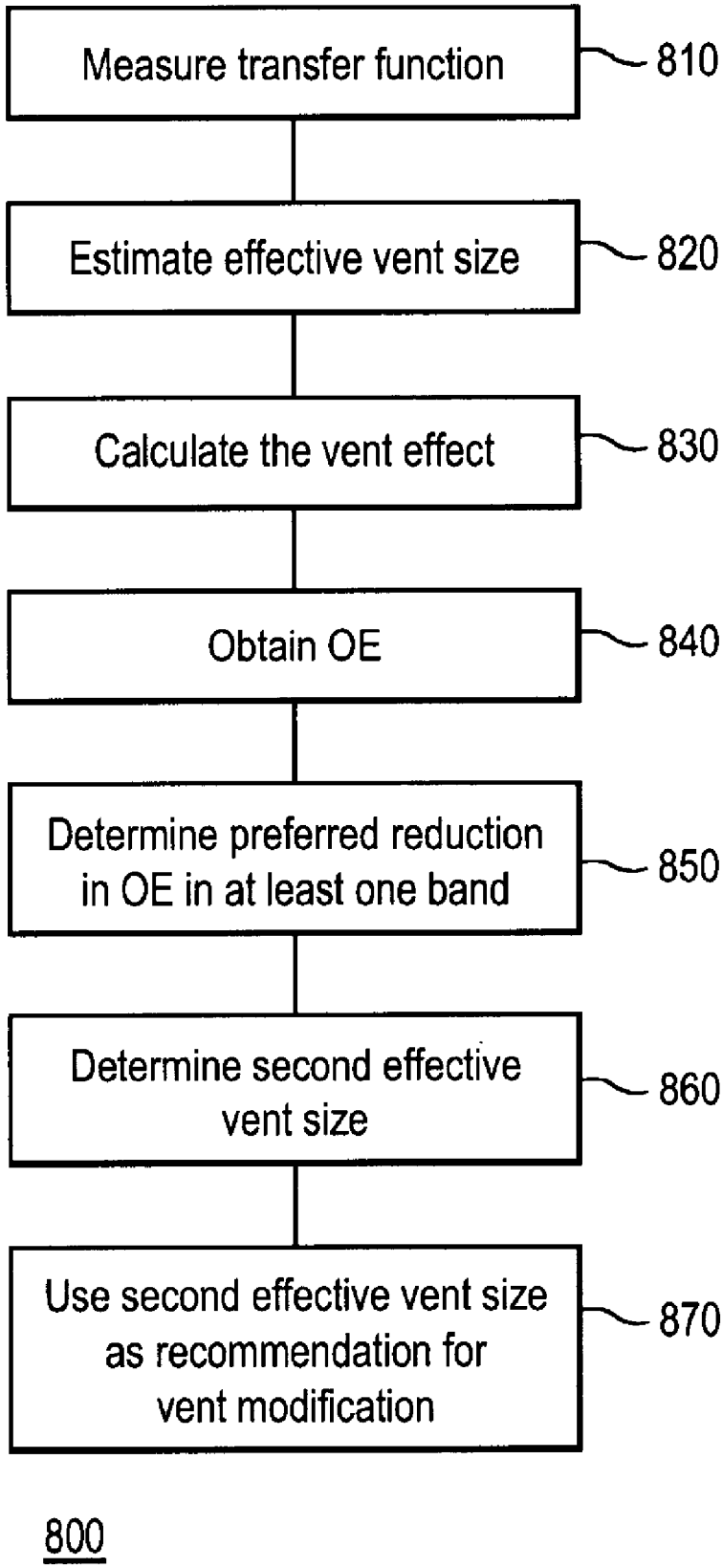
FIG. 8 illustrates a flow chart of a method according to an embodiment of the present invention.

It is now described how the determination of a vent size producing an occlusion effect which is tolerable is achieved by using the method as shown in the flow chart 800 of FIG. 8. In step 810, at least one transfer function of the hearing aid is measured. The transfer function could be, for example, a measured feed back test or measured DTG. An effective vent size for said hearing aid is then estimated by determining that vent size as the effective vent size that provides the best fit between a number of predetermined transfer function values and the measured transfer function (step 820). The vent effect corresponding to the said effective vent size and a number of other vent sizes is calculated (step 830). Then the calculated occlusion effect is obtained (step 840). In next step 850, the preferred reduction in occlusion effect in at least one band, such that said occlusion effect is below, for example, 8 dB in that one band, is determined. This information provided by said calculated vent effect is used to determine a second effective vent size, which has a vent effect which corresponds to the said preferred reduction in occlusion effect (step 860). The determined second vent size is used as a recommendation for vent modification to obtain an occlusion effect which is convenient for the user (step 870).

Figure 9:
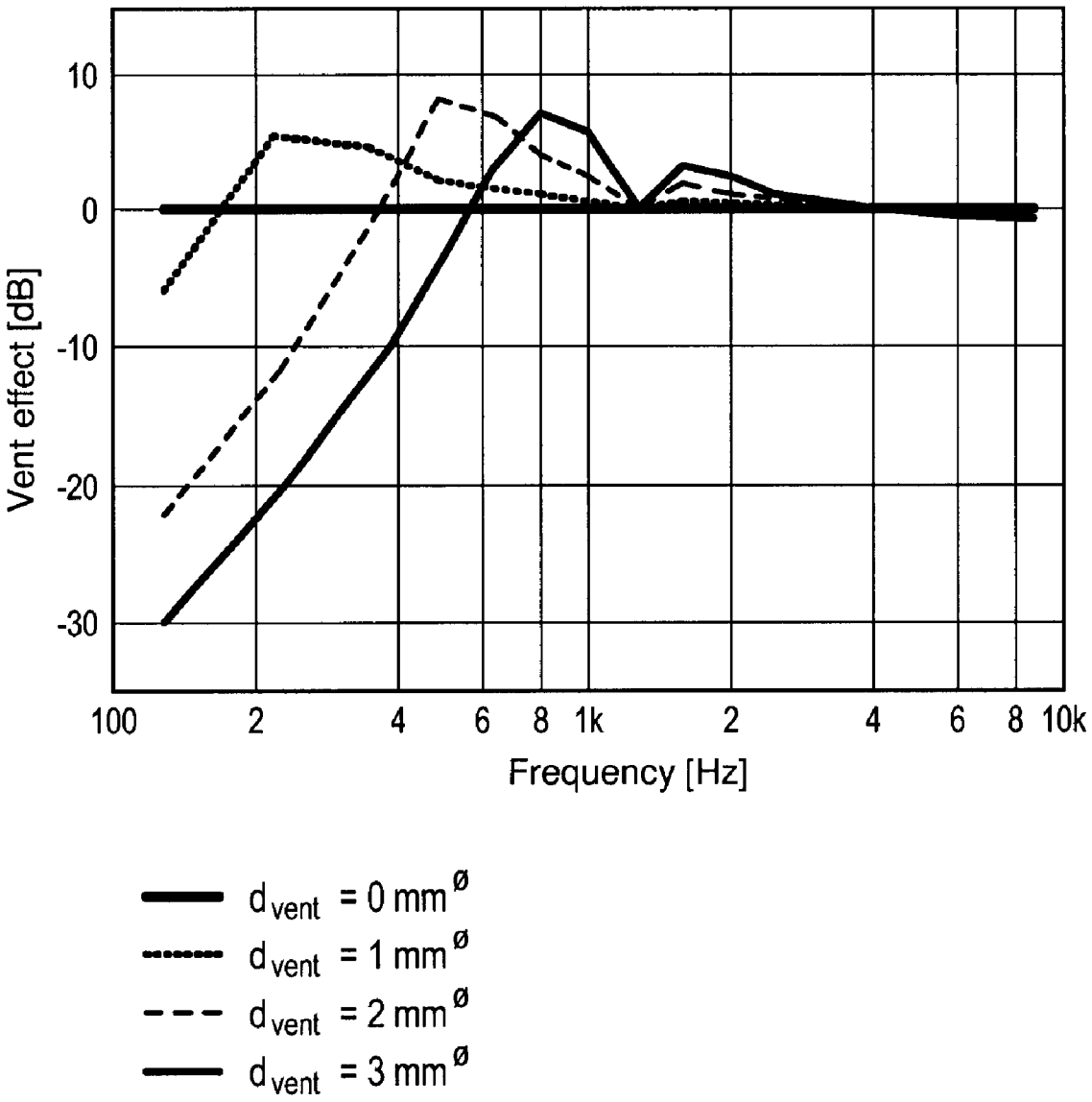
FIGS. 9 and 10 illustrate plots visualizing the frequency dependent vent effect and the occlusion effect according to embodiments of the present invention.

With reference to FIGS. 9 and 10, this method is now described in more detail. Included in the predetermined transfer function is the vent effect, which is the difference in the hearing aid sound pressure at the ear drum when the ear mould is vented and when it is un-vented. The pool of predetermined transfer functions thus contain frequency dependent vent effects corresponding to a number of effective vent diameters. This is illustrated in the FIG. 9 for three different vent diameters. It is assumed that the feedback test estimates the effective vent diameter to be 1.8 mm.

An occlusion effect measurement may give a result of 15 dB in the low frequencies, as shown in FIG. 10. Since studies have shown that an occlusion effect of less than 6, and in particular about 5 dB, is tolerable, it is necessary to increase the vent size of the ear mould, such that the sound pressure at the eardrum decreases with 10 dB.

From the predetermined vent effect chart in FIG. 9, it can be seen that an effective vent diameter of 1.8 mm (not shown, but will be placed just above the 2 mm curve in the figure to the left, with its end point at −20 dB) gives a 20 dB reduction in the lowest band. However, since the occlusion effect is measured with the same plug as the feed back test, and thereby the effective diameter, the 20 dB reduction was not enough. A further reduction of 10 dB is required to make the measured occlusion effect go from 15 dB to 5 dB. In the chart in FIG. 9, it can be seen that an increase of the vent diameter to 3 mm would give the necessary 10 dB reduction relative to the 1.8 mm.

An increase in vent size from 1.8 mm to 3 mm would thereby diminish the occlusion effect to a level where it is convenient to the user.

According to an embodiment, there is also provided a system of in-situ occlusion effect measurement by use of a hearing aid as described herein worn by a user in a fitting situation. The system further comprises a data processing system like a computer 85 and a computer program, which when executed on the data processing system enables the system to carry out a method as described herein in connection with the present invention. According to an embodiment, the computer program includes the fitting software 80 for fitting the hearing aid by taking the OE and the DTG into account. The system is functionally connected to the hearing aid by the interface 60 and further comprises a datalogger 90 to log the signal data sent to the system, e.g. by the regularly sent level reports. According to another embodiment, the datalogger stores values of the OE and the DTG as well as all signals transmitted from the hearing aid for further analysis and visualization. According to another embodiment, the system further comprises visualization means 90 like a computer monitor which is adapted to visualize to OE and DTG as well as all other data necessary for fitting the hearing aid as described herein. Thus, the dispenser may directly see and analyze the measured values by the hearing aid on the screen during a pre-fitting or fitting situation.

In summary, there are provided hearing aids and methods suitable to enable a more accurate vent size determination taking the occlusion effect or directly transmitted sound into account, thus giving as result a more convenient listening feeling to the user.

According to embodiments of the present invention, systems and hearing aids described herein may be implemented on signal processing devices suitable for the same, such as, e.g., digital signal processors, analogue/digital signal processing systems including field programmable gate arrays (FPGA), standard processors, or application specific signal processors (ASSP or ASIC). Obviously, it is preferred that the whole system is implemented in a single digital component even though some parts could be implemented in other ways—all known to the skilled person.

Hearing aids, methods, systems and other devices according to embodiments of the present invention may be implemented in any suitable digital signal processing system. The hearing aids, methods and devices may also be used by, e.g., the audiologist or dispenser in a fitting session. Methods according to the present invention may also be implemented in a computer program containing executable program code executing methods according to embodiments described herein. If a client-server-environment is used, an embodiment of the present invention comprises a remote server computer which embodies a system according to the present invention and hosts the computer program executing methods according to the present invention. According to another embodiment, a computer program product like a computer readable storage medium, for example, a floppy disk, a memory stick, a CD-ROM, a DVD, a flash memory, or any other suitable storage medium, is provided for storing the computer program according to the present invention.

According to a further embodiment, the program code may be stored in a memory of a digital hearing device or a computer memory and executed by the hearing aid device itself or a processing unit like a CPU thereof or by any other suitable processor or a computer executing a method according to the described embodiments.

Having described and illustrated the principles of the present invention in embodiments thereof, it should be apparent to those skilled in the art that the present invention may be modified in arrangement and detail without departing from such principles. Changes and modifications within the scope of the present invention may be made without departing from the spirit thereof, and the present invention includes all such changes and modifications.

What is claimed is:

1. A hearing aid for measurement of in-situ occlusion effect or directly transmitted sound, said hearing aid comprising:

a first microphone adapted to generate a first input signal from sounds external to a user of the hearing aid;

a signal processing means;

a receiver; and a second microphone adapted to generate a second input signal from sounds in the occluded ear of the user;

said signal processing means being adapted to generate a hearing loss compensated electric output signal from said first input signal, and said receiver being adapted to produce an acoustic output signal from said electric output signal; and said hearing aid being adapted to selectively enter a measurement mode, in which said mode receiver is silent and said signal processing means is adapted to produce at least one occlusion effect value or at least one directly transmitted sound value from the difference between simultaneously generated sound levels of the second and the first input signals.

2. The hearing aid according to claim 1, further comprising interface means for connection to a fitting device and adapted to transmit said input signals, said occlusion effect values, and said directly transmitted sound values for further processing in said fitting device.

3. The hearing aid of claim 1 comprising a band split filter, said band split filter being adapted to convert said first and second input signals into first and second band-split input signals, respectively, in a plurality of frequency bands comprising at least one frequency band below approximately 1 kHz.

4. The hearing aid according to claim 1, wherein in said measurement mode said receiver is used as said second microphone generating said second input signal.

5. The hearing aid according to claim 1, wherein said hearing aid is a behind-the-ear hearing aid and said second microphone is a built-in microphone of the hearing aid, associated with a probe tube having a first end being coupled to said second microphone and a second end being inserted into the ear canal of the user, and being adapted to propagate sounds in the occluded ear to the second microphone.

6. The hearing aid according to claim 1, wherein said hearing aid is an in-the-ear or completely-in-the-canal hearing aid and said second microphone is a built-in microphone at a receiver side of the hearing aid.

7. A hearing aid system for measurement of occlusion effect or directly transmitted sound, the system comprising a pair of a first hearing aid for one ear of a user and a second hearing aid for the other ear of the user, wherein said first hearing aid comprises:

a first microphone adapted to generate a first input signal from sounds external to a user of the first hearing aid;

a first signal processing means; and a first receiver;

wherein said second hearing aid comprises:

a second microphone;

a second signal processing means; and a second receiver;

said first signal processing means being adapted to generate a hearing loss compensated electric output signal from said first input signal, and said first receiver is adapted to produce a first acoustic output signal from said electric output signal; and wherein said system is adapted to selectively enter a measurement mode wherein said second microphone is adapted to generate a second input signal from sounds in the occluded ear of the user, said second receiver is silent and one of said first or second signal processing means is adapted to produce at least one occlusion effect value or at least one directly transmitted sound from the difference between simultaneously generated sound levels of the second and the first input signals.

8. The system of claim 7, wherein said second hearing aid comprises a second band split filter, said second band split filters being adapted to convert said second input signal into second band-split input signals in a plurality of respective frequency bands comprising at least one frequency band below approximately 1 kHz.

9. The system according to claim 7, wherein said second microphone is associated with a probe tube inserted into the ear canal of the user, said probe tube being adapted to propagate sounds in the occluded ear to said second microphone.

10. The system according to claim 8, comprising detection means adapted to determine whether in at least one frequency band the sound level of the second input signal is larger than that of the first input signal in the measurement mode and if this is the case to classify the input signals as valid for occlusion effect calculation.

11. The system according to claim 10, wherein if in at least one frequency band the sound level of the second input signal is smaller than that of the first input signal, the detection means is adapted to classify the input signals as valid for calculating a value of the directly transmitted sound from the second and the first input signals.

12. A method for measurement of in-situ occlusion effect or direct transmission sound by means of a hearing aid having a first microphone for generating a first input signal from sounds external to a user of the hearing aid and a receiver, said method comprising the steps of:

generating a hearing loss compensated output signal from said first input signal output by the receiver in a normal hearing aid mode;

switching said hearing aid from said normal hearing aid mode into a measurement mode, causing said receiver to be silent, and carrying out the following steps:

simultaneously generating said first input signal and a second input signal, wherein said second input signal is generated by a second microphone from sounds in the occluded ear of the user; and calculating at least one occlusion effect or directly transmitted sound value from the difference between the sound levels of said second and first input signals.

13. The method according to claim 12 comprising converting said first and second input signals into first and second band split input signals, in a plurality of respective frequency bands comprising at least one frequency band below approximately 1 kHz; and calculating at least one occlusion effect or directly transmitted sound value from the difference between the sound levels of said second and first input signal of a frequency band below 1 kHz.

14. The method according to claim 12, wherein said receiver is used as said second microphone generating said second input signal in said measurement mode.

15. The method according to claim 12, wherein said method uses a pair of a first hearing aid for one ear of a user and of a second hearing aid for the other ear of the user for occlusion effect measurement, wherein said first input signal is generated by said first hearing aid and said second input signal is generated by said second hearing aid.

16. A method for fitting a hearing aid to a user, said hearing aid having a first microphone for generating a first input signal from sounds external to a user of the hearing aid and a receiver, said method comprising the steps of:

generating a hearing loss compensated output signal from said first input signal output by the receiver in a normal hearing aid mode;

switching said hearing aid from said normal hearing aid mode into a measurement mode, causing said receiver to be silent, and carrying out the following steps:

simultaneously generating said first input signal and a second input signal, wherein said second input signal is generated by a second microphone from sounds in the occluded ear of the user;

calculating at least one occlusion effect or directly transmitted sound value from the difference between the sound levels of said second and first band-split input signals; and fitting said hearing aid based on at least one of said occlusion effect value and said directly transmitted sound value.

17. A method for vent size determination for a hearing aid by means of in-situ occlusion effect measurement, said hearing aid having a first microphone for generating a first input signal from sounds external to a user of the hearing aid and a receiver, said method comprising the steps of:

providing an ear of a user with a prospective hearing aid, said prospective hearing aid occluding said ear of the user;

generating a hearing loss compensated output signal from said first input signal output by the receiver in a normal hearing aid mode;

switching said hearing aid from said normal hearing aid mode into a measurement mode, causing said receiver to be silent, and carrying out the following steps:

simultaneously generating said first input signal and a second input signal, wherein said second input signal is generated by a second microphone from sounds in the occluded ear of the user;

calculating at least one occlusion effect or directly transmitted sound value from the difference between the sound levels of said second and first input signals; and determining the vent size for said hearing aid based on at least one of the calculated occlusion effect and the directly transmitted sound value.

18. The method according to claim 17, wherein the ear of the user is occluded by a soft plug inserted into the ear canal of the user.

19. The method according to claim 17, wherein the step of determining the vent size comprises:

measuring at least one transfer function of said hearing aid;

estimating an effective vent size for said hearing aid by determining that vent size as said effective vent size that provides the best fit between a number of predetermined transfer function values and the measured transfer function;

calculating the vent effect corresponding to the said effective vent size and a number of other vent sizes;

determining the preferred reduction in occlusion effect in at least one band, such that said occlusion effect is below 8 dB in at least one band;

using the information provided by said calculated vent effect to determine a second effective vent size, which has a vent effect which corresponds to the preferred reduction in occlusion effect; and using said second vent size as a recommendation for vent modification to obtain an occlusion effect which is convenient for the user.

20. A system for measurement of in-situ occlusion effect or directly transmitted sound by use of a hearing aid, the hearing aid having a first microphone adapted to generate a first input signal from sounds external to a user of the hearing aid; a signal processing means; a receiver; and a second microphone adapted to generate a second input signal from sounds in the occluded ear of the user; said signal processing means being adapted in a normal hearing aid mode to generate a hearing loss compensated electric output signal from said first input signal, and said receiver being adapted to produce an acoustic output signal from said electric output signal; said system comprising a data processing system; and a computer program, which when executed on said data processing system enables the system to switch said hearing aid from said normal hearing aid mode into a measurement mode, causing said receiver to be silent, and carrying out the following steps:

simultaneously generating said first input signal and a second input signal, wherein said second input signal is generated by a second microphone from sounds in the occluded ear of the user;

and calculating at least one occlusion effect or directly transmitted sound value from the difference between the sound levels of said second and first band-split input signals.

* * * * *